US005324448A

United States Patent [19]

Mayeaux

[11] Patent Number: 5,324,448

[45] Date of Patent: Jun. 28, 1994

[54] COMBINATION DESSICANT AND VAPOR-CORROSION INHIBITOR

[75] Inventor: Donald P. Mayeaux, Prairieville, La.

[73] Assignee: A + Corp., Prairieville, La.

[21] Appl. No.: 990,041

[22] Filed: Dec. 14, 1992

[51] Int. Cl.[5] ..... C23F 11/14

[52] U.S. Cl. ..... 252/194; 106/14.42; 252/389.62; 252/394; 206/204; 422/9; 422/16

[58] Field of Search ..... 252/194, 396, 389.62, 252/394; 422/9, 16; 106/14.42; 206/204

[56] References Cited

U.S. PATENT DOCUMENTS

| | | | |
|---|---|---|---|
| 2,577,219 | 12/1951 | Wachter et al. | 21/2.5 |
| 2,643,176 | 6/1953 | Wachter et al. | 21/2.5 |
| 2,752,221 | 5/1956 | Wachter et al. | 21/2.5 |
| 3,836,077 | 9/1974 | Skildum | 239/60 |
| 3,967,926 | 7/1976 | Rozenfeld et al. | 21/2.5 |
| 3,990,872 | 11/1976 | Cullen | 206/204 |
| 4,275,835 | 6/1981 | Miksic et al. | 239/60 |
| 4,290,912 | 9/1981 | Boerwinkle et al. | 422/9 |
| 4,295,987 | 10/1981 | Parks | 252/194 |
| 4,548,847 | 10/1985 | Aberson et al. | 428/74 |
| 4,973,448 | 11/1990 | Carlson et al. | 422/9 |

OTHER PUBLICATIONS

WO88/08440 Freeman; Clarence S. Nov. 3, 1988.

"Organic Corrosion Inhibitors in the Electronics Industry", D. Vanderpool et al., *Corrosion/86*, paper #1, NACE, Houston, Tex.

"Cobratec ® Inhibitors," G. K. Meloy, PMC Specialties Group, Inc., Cincinnati, Ohio.

"Volatile Corrosion Inhibitors for Protection of Electronics," M. E. Tarvin et al., *Corrosion/89*, paper No. 344, Apr. 1989, New Orleans, La.

*Primary Examiner*—Robert L. Stoll
*Assistant Examiner*—Valerie Fee
*Attorney, Agent, or Firm*—Reginald F. Roberts, Jr.

[57] ABSTRACT

A composition for inhibiting corrosion. The composition contains a mixture of a dessicant and a vapor-corrosion inhibitor. The mixture of dessicant and inhibitor is synergistic: the service life of the corrosion inhibitor is signficiantly longer when so used than when used alone or in in the presence of but not physically mixed with the dessicant.

1 Claim, 1 Drawing Sheet

COMBINATION DESSICANT AND VAPOR-CORROSION INHIBITOR

BACKGROUND OF THE INVENTION

The present invention relates to the inhibition of the corrosion of metals by vapors to which the metals are exposed. More particularly, the invention relates to the inhibition of the corrosion of electrical components disposed in an enclosure.

It is well known that the presence of water molecules adsorbed on surfaces as a result of exposure to humid atmospheres enhances metal corrosion in such an atmosphere. It is likewise known that water molecules adsorbed on the surface of electrically-insulating materials can promote sufficient undesired electrical conduction between circuit components as to severely disrupt high-impedance electrical circuits. Airborne contaminants such as hydrogen sulfide, chlorine, and salt particles, particularly under conditions of high humidity, are a major cause of electrical circuit component corrosion and subsequent failure.

As used herein, the term "impedance" is meant to signify any form of electrical resistance, either to direct current or to alternating current.

The concept of employing dessicants and vapor-corrosion inhibitors independently and physically separated within the same enclosure is known in the art. A problem frequently encountered is the need for frequent and/or periodic replacement of the dessicant. Typical service life for a dessicant packet is from about three to six months. This situation and condition often precludes the use of dessicants in combination with but physically separated from vapor-corrosion inhibitors.

Vapor-corrosion inhibitors are materials which inhibit corrosion of the surface of metals contacted by vapors of the corrosion inhibitors. Ideally, a vapor-corrosion inhibitor would vaporize at a rapid rate when first placed in service, to provide immediate protection to electrical components within an enclosure, and thereafter vaporize at a slower rate, to increase the duration of protection. Many patents and scientific articles teach methods which attempt to achieve this ideal condition. Most prior-art techniques employ either mixtures of inhibitors having a wide range of vapor pressure, or provide means for limiting the vaporization and/or vapor diffusion rate of the inhibitors. Both approaches limit the choice of the vapor-corrosion inhibitor which can be utilized.

U.S. Pat. No. 2,577,219 to Wachter et al, issued Dec. 4, 1951, discloses a method of preventing or inhibiting corrosion of metal surfaces by employing a plurality of vapor-corrosion inhibitors in the presence of each other under conditions in which at least two of the inhibitors are complementary to one another.

U.S. Pat. No. 2,643,176 to Wachter et al., issued Jun. 23, 1953, discloses compositions for protection of metals against corrosion. The compositions comprise a substantially solid material which contains, or is impregnated or coated with, a vapor-corrosion inhibitor.

U.S. Pat. No. 2,752,221 to Wachter et al, issued Jun. 26, 1956, discloses methods and compositions for use in protecting metals from corrosion, especially by water vapor and oxygen, as in humid air. The vapor-corrosion inhibitors comprise a basic agent and a water-soluble organic nitrite.

U.S. Pat. No. 3,836,007 to Skildum, issued Sep. 17, 1974, discloses a device for protecting structures from corrosion during storage. The device includes a carrier defining at least one opening therein. The opening contains a mixture of organic ammonium nitrites with varying vapor pressures, a chemical buffer system for neutralizing lead acids, and a volatile anti-oxidant for preventing the formation of varnish and scavenging oxygen from varnish deposits.

U.S. Pat. No. 3,967,926 to Rozenfeld et al., issued Jul. 6, 1976, discloses a method for inhibiting atmospheric corrosion of metals in a sealed space with inhibiting amounts of vapor-phase inhibitors. The method consists of disposing in the sealed space a carrier for storing a stock of inhibitors, and diffusing their vapors within the space. The carrier is silica gel or zeolite, and contains a liquid inhibitor selected from the group consisting of primary, secondary and tertiary amines, and mixtures thereof.

U.S. Pat. No. 4,275,835 to Miksic et al., issued Jun. 30, 1981, discloses a corrosion-inhibiting device which includes an extremely stable, man-made synthetic carrier having chemical and physical stabilities compatible with hostile and adverse environments, for dispensing corrosion-inhibiting chemicals.

Scientific or technical articles which review the role of vapor-corrosion inhibitors in the electronics industry include "Corrosion Inhibitors in the Electronics Industry: Organic Copper Corrosion Inhibitors," by D. Vanderpool, S. Akin and P. Hassett, *Corrosion/86*, Paper No. 1, Houston, Texas, 1986; "COBRATEC® Inhibitors: Corrosion Protection for Electronics," by Gilbert K. Meloy, PMC Specialties Group, Inc., Cincinnati, Ohio; and "Volatile Corrosion Inhibitors for Protection of Electronics," by Michael E. Tarvin and Boris A. Miksic, *Corrosion/89*, Paper No. 344, Apr. 17-21, 1989, New Orleans Convention Center, New Orleans, La.

SUMMARY OF THE INVENTION

In general, the present invention provides a composition for extending the service life of a vapor-corrosion inhibitor. The composition comprises (a) from about ten to about ninety-nine and nine-tenths percent by weight of a dessicant, and (b) from about one-tenth to about ninety percent by weight of a vapor-corrosion inhibitor mixed with the dessicant.

DETAILED DESCRIPTION OF THE INVENTION

Figure 1:
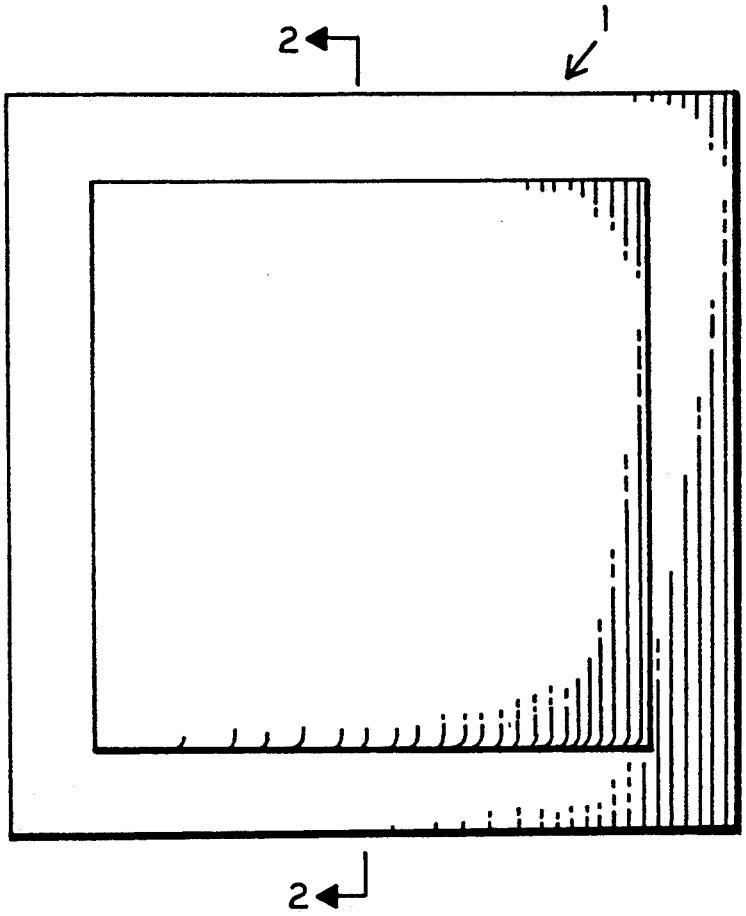
FIG. 1 is a plan view of a packet for the inhibition of vapor corrosion, made in accordance with the principles of the present invention.

More specifically, reference is made to FIG. 1, wherein is shown a packet, generally designated by the numeral 1, for inhibiting vapor corrosion, made in accordance with the principles of the present invention.

Figure 2:
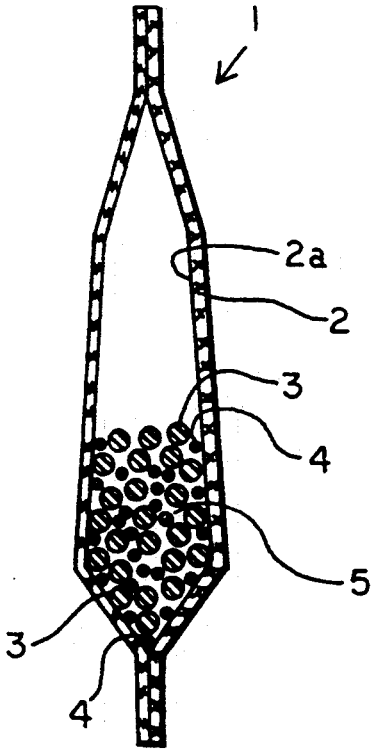
FIG. 2 is a cross-sectional view of the packet shown in FIG. 1, taken along the cutting line 2—2, showing the contents of the packet before exposure to a humid atmosphere.

Reference is now made to FIG. 2, wherein is shown a cross-sectional view of the packet 1. The packet 1 comprises a mixture 5 of a granular dessicant 3 and a granular vapor-corrosion inhibitor 4. The mixture 5 is contained in and by a porous film 2 which is pervious to water vapor and to the vapor of the corrosion inhibitor 4.

When the packet 1 is first placed in service in an enclosure (not shown) containing electrical or electronic components (not shown) in a humid atmosphere, the vapor-corrosion inhibitor 4 provides a relatively high volume of vapors. This is because part of the corrosion inhibitor 4 is in direct contact with the inner surface 2*a* of the film 2, from which area it can readily diffuse through the film 2. Preferably, the vapor-corrosion inhibitor 4 has a relatively high vapor pressure, and therefore provides rapid initial corrosion protection to surrounding surfaces.

Figure 3:
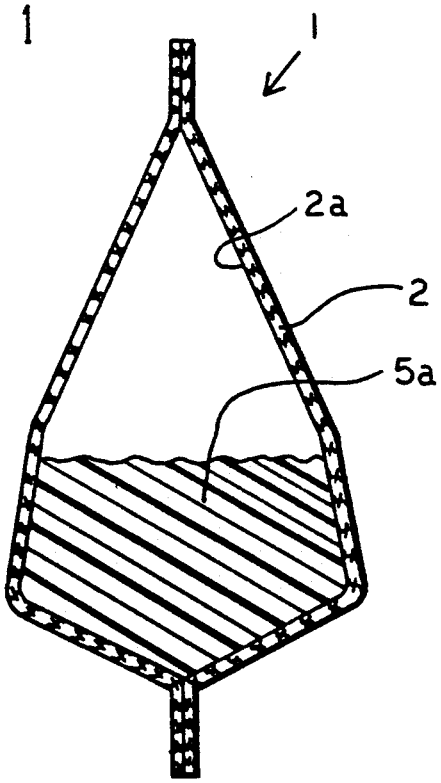
FIG. 3 is a cross-sectional view of the packet after exposure of the contents to a humid atmosphere.

Within a period of from a few hours to about one month, the dessicant 3 typically absorbs a sufficient amount of water vapor to become gelled into a putty-like mass 5*a* shown in FIG. 3, thereby expanding the portion of the packet 1 filled with the mixture 5, 5*a* of the dessicant 3 and the corrosion inhibitor 4. The exact length of time for this phenomenon to occur will vary with ambient humidity levels, tightness of the enclosure, volume ratio of the dessicant 3 to the enclosure's internal volume, and the nature of the dessicant 3.

When the dessicant 3 gels, the rate of vaporization of the corrosion inhibitor 4 drops significantly. Preferably, the vapor-corrosion inhibitor 4 is a material which dissolves wholly or at least partially in the gel 5*a*. Thereafter the vapor-corrosion inhibitor 4 begins to vaporize primarily at the outer edge of the gel. Vapor-corrosion inhibitor 4 near the center of the gel 5*a* must now diffuse through the putty-like mass to reach the inner surface 2*a* of the film 2.

The result of this sequence of occurrences is that, when first placed in service, the mixture 5 in the packet 1 releases corrosion-inhibitor 4 vapor at a maximum rate. This provides immediate initial protection. Only much smaller amounts of corrosion-inhibitor 4 vapor are required thereafter to maintain corrosion protection. By slowing down the rate of vaporization of the corrosion inhibitor 4 after an initially high burst of corrosion-inhibitor 4 vapor, the effective life of the vapor-corrosion inhibitor 4 is greatly extended.

The beneficial effect of the present composition relative to prior-art compositions will be more fully appreciated when considered in the light of the well-known fact that the deterimental effects to electrical circuits, caused by water vapor in ambient air due to increased corrosion and loss of insulation characteristics, increases exponentially with increases in relative humidity. The composition of the present invention effectively prevents high-humidity excursions without wastefully and unnecessarily loading the dessicant 3 near its capacity to absorb moisture. The dessicant 3 buffers the relative humidity within the enclosure by absorbing and desorbing water vapor. The dessicant 3 absorbs water vapor from the surrounding air until the absorbed water loading is in equilibrium with the relative humidity of the surrounding air. If the relative humidity rises above this equilibrium level due to "breathing" or other cause, the dessicant 3 responds by absorbing more water vapor until the absorption capacity of the dessicant 3 and the relative humidity are again in equilibrium.

If the relative humidity within the enclosure falls, the dessicant 3 responds by desorbing water vapor until equilibrium is again established. In this manner the dessicant 3 maintains a substantially constant long-term relative humidity within the enclosure. It has been found that the relative humidity maintained in this manner, when the appropriate amounts of dessicant 3 are used for a given enclosure, approximates the long-term average relative humidity of the surrounding ambient atmosphere. A study of the daily changes of relative humidity which occur in the humid gulf-coast states showed that most high relative-humidity excursions occur for only short periods of time. In practice, it has been found that the preferred dessicants can control the levels of relative humidity within an enclosure at acceptable levels over long periods of time. This was found to be true even in the very humid environments experienced by offshore oil-drilling platforms and ships/vessels. By preventing high-peak excursions, water-vapor enhanced corrosion and undesired conduction paths in high-impedance circuits are significantly reduced.

By having the capability of absorbing and desorbing water vapor at normal ambient levels, the preferred dessicants 3 become self-regenerating. By contrast, many prior-art dessicants, such as silica gel, become quickly saturated with water vapor at even low ambient levels of, relative humidity, and are incapable of releasing any significant amounts of the absorbed water vapor under ambient atmospheric conditions.

Preferred dessicants 3 exhibit the following characteristics: (a) a large absorption capacity for water vapor in ambient air; (b) the ability to absorb and desorb water vapor in response to changes in the relative humidity of the air; and (c) the characteristic of gelling to a putty-like mass upon exposure to ambient air at normal or high levels of relative humidity.

In accordance with the characteristics listed above, preferred dessicants 3 according to the principles of the present invention include certain polymers, notably an alkali-metal poly(acrylate) and an alkali-metal partial salt of crosslinked poly(propenoic acid). Of these, potassium poly(acrylate) and the partial sodium salt of crosslinked poly(propenoic acid) are most preferred.

Preferred corrosion inhibitors 4 exhibit the following characteristics:

(a) They produce vapors which inhibit corrosion upon contact with the surface of a metallic electrical conductor.

(b) They vaporize at a rate sufficient to provide effective corrosion protection to surrounding electrical conductive metals within a short time.

(c) They are chemically compatible with the preferred dessicants 3.

(d) They are soluble or at least partially soluble in the gelled dessicant 3.

Preferred vapor-corrosion inhibitors 4 exhibiting the above characteristics include aromatic triazoles. Even more preferably, they include benzotriazole and tolyltriazole. The vapor pressures of benzotriazole and tolyltriazole at 40° C. are 0.09 and 0.02 millimeters of mercury, respectively. Their vapors provide excellent corrosion protection for all metals commonly used in or associated with electrical circuits, such as copper, silver, lead, tin and zinc. Both compounds are sufficiently water soluble to diffuse through the dessicant 3 gelled mass 5*a* (FIG. 3), and to diffuse rapidly through the granular dessicant 3 and porous film 2 of the packet 1 (FIG. 2), to provide corrosion protection to surrounding metal surfaces in a very short time. In practice, a significant degree of corrosion protection is achieved with either triazole within three to five days. Other vapor-corrosion inhibitors include dicyclohexylamine nitrite, sold by the Olin Company under the registered trademark DICHAN.

While the film 2 may be formed of any porous material which allows the vapors of water and the corrosion inhibitor 4 to diffuse therethrough, a preferred material is a spunbonded olefin. The spun-bonded olefin most preferred is spun-bonded ethylene, a poly(ethylene) marketed as TYVEK, a registered trademark of the duPont de Nemours Company.

Packets 1 and mixtures 5 made in accordance with the principles of the present invention exhibit a synergistic effect. The duration of the service life of the corrosion inhibitor is greater for the mixture 5, 5*a* than the durations of the service life observed for the corrosion inhibitor not mixed with the dessicant, whether the service life is measured in the presence of component 4 alone, or components 3 and 4 used simultaneously but physically separated from one another.

A first preferred embodiment of the invention comprises a mixture 5, 5*a* of from about ten percent to about ninety nine and nine-tenths percent potassium poly(acrylate), and from about one-tenth to about ninety percent benzotriazole by weight.

A second preferred embodiment comprises a mixture 5, 5*a* of from about ten to about ninety-nine and nine-tenths percent potassium poly(acrylate), and from about one-tenth to about ninety percent tolyltriazole by weight.

A third preferred embodiment comprises a mixture 5, 5*a* of from about ten to about ninety-nine and nine-tenths percent of the partial sodium salt of cross-linked poly(propenoic acid), and from about one-tenth to about ninety percent by weight of an aromatic triazole.

The vapor pressures of three vapor-corrosion inhibitors are shown in Table I, below.

TABLE I

| Vapor-Corrosion Inhibitor | Temperature (°C.) | Vapor Pressure (mm Hg) |
|---|---|---|
| Benzotriazole | 40 | 0.09 |
| Tolyltriazole | 40 | 0.02 |
| Dicyclohexylamine Nitrile | 25 | 3.3 |

The present invention will now be illustrated by the following examples, which are solely illustrative and which are not to be construed as limiting the scope of the invention.

EXAMPLE I

In this example and in Example II, weight losses of the pure vapor-corrosion inhibitor were determined gravimetrically. Indirect means were employed to measure the rates of vaporization (weight loss) of the vapor corrosion inhibitors for the mixtures. Direct means were not feasible because large weight changes occurred in the dessicant as a result of water-vapor absorption. The indirect method comprised determining the corrosion-inhibiting properties of the vapor in an enclosed vessel under controlled conditions. These properties were in turn compared to the results obtained in a test run under the same conditions with the pure vapor-corrosion inhibitor, where weight loss could be and was measured directly.

The rate of weight loss, expressed as grams per year, at 22° C. and a relative humidity of one-hundred percent, of the three vapor-corrosion inhibitors benzotriazole (BZT), tolyltriazole (TT), and dicyclohexylamine nitrite (DICHAN) was determined as described above, both for the pure inhibitors and for mixtures packeted in TYVEK ® of the inhibitors with the dessicant comprising the partial sodium salt of crosslinked poly(propenoic acid). The rate of weight loss was measured both initially; i.e., when the mixtures were prepared; and again after six months, when the mixtures had gelled. The results obtained in this experiment are collected in Table II, below.

TABLE II

| Inhibitor (VCI) | Rate of Weight Loss (grams/year) | | | | | | |
|---|---|---|---|---|---|---|---|
| | | VCI + Dessicant | | | | | |
| | | Initially-Dry VCI (%) | | | After 6 mos-gelled VCI (%) | | |
| | VCI only | 0.1 | 20 | 90 | 0.1 | 20 | 90 |
| BZT | 0.34 | 0.3 | 0.4 | 0.4 | 0.05 | 0.1 | 0.20 |
| TT | 0.078 | 0.05 | 0.07 | 0.07 | 0.01 | 0.02 | 0.03 |
| DICHAN | 6.56 | 5.3 | 6.0 | 6.1 | 0.3 | 1.5 | 1.8 |

EXAMPLE II

Under the same conditions and using the same experimental procedure as in Example I, above, the rate of weight loss of the same three vapor-corrosion inhibitors (VCI) was determined for mixtures of the inhibitors with the dessicant potassium poly(acrylate). The results are summarized in Table III, below.

TABLE III

| Inhibitor (VCI) | Rate of Weight Loss (grams/year) | | | | | | |
|---|---|---|---|---|---|---|---|
| | | VCI + Dessicant | | | | | |
| | | Initially-Dry VCI (%) | | | After 6 mos-gelled VCI (%) | | |
| | VCI only | 0.1 | 20 | 90 | 0.1 | 20 | 90 |
| BZT | 0.34 | 0.3 | 0.4 | 0.4 | 0.03 | 0.1 | 0.20 |
| TT | 0.078 | 0.06 | 0.08 | 0.08 | 0.01 | 0.02 | 0.04 |
| DICHAN | 6.56 | 6.0 | 7.0 | 6.6 | 0.5 | 1.8 | 2.5 |

It can be seen from the data of Tables II and III that the vapor-corrosion-inhibitor mixtures initially lost weight at approximately the same rate as did the pure inhibitors. After the mixtures had been exposed to a one-hundred-percent relative humidity environment for seven days, the mixtures had gelled, and a significant reduction in rate of weight loss by the inhibitors was observed. Similar results were observed (as shown) after the mixtures had been exposed to the same or to a comparable environment for six months. When the packets 1 were opened, it was apparent that the inhibitors had partially dissolved in the gelled dessicants. The dicyclohexylamine nitrite (DICHAN) appeared to have dissolved to a lesser extent or degree than the benzotriazole (BZT) and the tolyltriazole (TT).

The large reduction in rate of weight loss which occurred after gellation is attributable to encapsulation. The data clearly show that this co-action between inhibitor and dessicant greatly increased the duration of protection provided by the vapor-corrosion inhibitors.

When the vapor-corrosion inhibitor and the dessicant are dispensed in separate packets, as is customary, the service life of the inhibitor is approximately two to three years. The test data (Tables II and III) suggest that the service life of inhibitors may be extended to approximately ten years by mixing the inhibitors with the dessicants as described above. This potential extension of service life is especially important in light of the fact that the dessicant does not require replacement due to its "self-regenerating" properties.

While certain particular embodiments and details have been used herein to describe and illustrate the present invention, it will be clear to those skilled in the art that many modifications can be made therein without departing from the spirit and scope of the invention.

I claim:

1. A composition for extending the service life of a vapor-corrosion inhibitor, the composition consisting essentially of:

(a) from about ten to about ninety-nine and nine-tenths percent by weight of a granular dessicant which gels upon exposure to water vapor; and (b) from about one-tenth to about ninety percent by weight of a granular vapor-corrosion inhibitor;

wherein the dessicant is the partial sodium salt of cross-linked poly(propenoic acid), and the vapor-corrosion inhibitor is an aromatic triazole.

* * * * *